US010823461B2

(12) United States Patent
Hellmann

(10) Patent No.: US 10,823,461 B2
(45) Date of Patent: Nov. 3, 2020

(54) EJECTOR REFRIGERATION CIRCUIT

(71) Applicants: Carrier Corporation, Farmington, CT (US); Sascha Hellmann, Mainz-Kostheim (DE)

(72) Inventor: Sascha Hellmann, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 340 days.

(21) Appl. No.: 15/573,668

(22) PCT Filed: May 13, 2015

(86) PCT No.: PCT/EP2015/060579

§ 371 (c)(1),
(2) Date: Nov. 13, 2017

(87) PCT Pub. No.: WO2016/180487

PCT Pub. Date: Nov. 17, 2016

(65) Prior Publication Data

US 2018/0066872 A1 Mar. 8, 2018

(51) Int. Cl.

| | |
|---|---|
| ***F25B 1/10*** | (2006.01) |
| ***F25B 9/00*** | (2006.01) |
| ***F25B 41/00*** | (2006.01) |

(52) U.S. Cl.

CPC ..... *F25B 1/10* (2013.01); *F25B 9/008* (2013.01); *F25B 41/00* (2013.01);
(Continued)

(58) Field of Classification Search

CPC ..... F25B 2341/0012; F25B 2341/0015; F25B 9/008

See application file for complete search history.

(56) References Cited

U.S. PATENT DOCUMENTS

| | | | |
|---|---|---|---|
| 2,295,462 | A | 9/1942 | Forman |
| 3,277,660 | A | 10/1966 | Kemper et al. |

(Continued)

FOREIGN PATENT DOCUMENTS

| | | | |
|---|---|---|---|
| DE | 102006058877 | A1 | 7/2007 |
| EP | 0780254 | A1 | 6/1997 |

(Continued)

OTHER PUBLICATIONS

International Search Report and Written Opinion for application PCT/EP2015/060579, dated Jan. 21, 2016, 12pages.

*Primary Examiner* — Filip Zec

(74) *Attorney, Agent, or Firm* — Cantor Colburn LLP

(57) ABSTRACT

An ejector refrigeration circuit comprises: a high pressure ejector circuit comprising in the direction of flow of a circulating refrigerant: a heat rejecting heat exchanger/gas cooler having an inlet side and an outlet side; at least one ejector comprising a primary high pressure input port, a secondary low pressure input port, and an output port, the primary high pressure input port being fluidly connected to the outlet side of the heat rejecting heat exchanger/gas cooler; a receiver, having a liquid outlet, a gas outlet and an inlet, which is fluidly connected to the output port of the at least one ejector; at least one compressor having an inlet side and an outlet side, the inlet side of the at least one compressor being fluidly connected to gas outlet of the receiver.

20 Claims, 3 Drawing Sheets

(52) U.S. Cl.
CPC ..... *F25B 2341/0012* (2013.01); *F25B 2341/0015* (2013.01); *F25B 2400/13* (2013.01); *F25B 2600/02* (2013.01); *F25B 2600/2501* (2013.01); *F25B 2700/195* (2013.01); *F25B 2700/197* (2013.01); *F25B 2700/1933* (2013.01); *F25B 2700/21151* (2013.01); *F25B 2700/21163* (2013.01); *F25B 2700/21175* (2013.01)

(56) References Cited

U.S. PATENT DOCUMENTS

| | | | | |
|---|---|---|---|---|
| 3,621,667 | A | 11/1971 | Mokadam | |
| 3,686,867 | A | 8/1972 | Hull | |
| 4,981,023 | A | 1/1991 | Krishnakumar | |
| 6,192,692 | B1 | 2/2001 | Alsenz | |
| 6,334,758 | B1 | 1/2002 | Popov | |
| 6,550,265 | B2 | 4/2003 | Takeuchi et al. | |
| 7,406,837 | B2 * | 8/2008 | Nemoto | F25B 25/005 62/332 |
| 8,936,202 | B2 * | 1/2015 | Kremer | F24D 1/00 236/13 |
| 9,372,014 | B2 * | 6/2016 | Nagano | F25B 41/00 |
| 9,863,677 | B2 * | 1/2018 | Yoshikawa | F25D 21/12 |
| 2010/0251759 | A1 | 10/2010 | Occhipinti | |
| 2010/0257893 | A1 * | 10/2010 | Oshitani | F25B 5/00 62/500 |
| 2010/0313582 | A1 | 12/2010 | Oh et al. | |
| 2011/0289961 | A1 | 12/2011 | Occhipinti | |
| 2012/0116594 | A1 | 5/2012 | Aidoun et al. | |
| 2012/0167601 | A1 | 7/2012 | Cogswell et al. | |
| 2013/0104593 | A1 | 5/2013 | Occhipinti | |
| 2014/0047855 | A1 | 2/2014 | Kolarich | |
| 2014/0260404 | A1 | 9/2014 | Verma | |
| 2017/0356681 | A1 * | 12/2017 | Douven | F25B 49/027 |

FOREIGN PATENT DOCUMENTS

| | | | |
|---|---|---|---|
| EP | 1273859 | A2 | 1/2003 |
| EP | 1300638 | A2 | 4/2003 |
| EP | 1719650 | A1 | 11/2006 |
| EP | 1870648 | A1 | 12/2007 |
| EP | 2136161 | A1 | 12/2009 |
| EP | 2754979 | A1 | 7/2014 |
| JP | 2005180911 | A | 7/2005 |
| JP | 2006038400 | A | 2/2006 |
| JP | 2010151424 | A | 7/2010 |
| JP | 2010243095 | A | 10/2010 |
| SU | 1399611 | A1 | 5/1988 |
| WO | 2008002048 | A1 | 1/2008 |

* cited by examiner

EJECTOR REFRIGERATION CIRCUIT

The invention is related to an ejector refrigeration circuit, in particular to an ejector refrigeration circuit further comprising a liquid pump, and a method of controlling such an ejector refrigeration circuit.

In a refrigeration circuit an ejector may be used as an expansion device which additionally provides a so called ejector pump for compressing refrigerant from a low pressure level to a medium pressure level using energy that becomes available when expanding the refrigerant from a high pressure level to the medium pressure level.

It is desirable to improve the efficiency of an ejector refrigeration circuit in particular when the pressure difference between the high pressure inlet and the outlet of the ejector is low.

In an exemplary embodiment of the invention the ejector refrigeration circuit includes a high pressure ejector circuit comprising in the direction of flow of a circulating refrigerant: a heat rejecting heat exchanger/gas cooler having an inlet side and an outlet side; at least one ejector comprising a primary high pressure input port, a secondary low pressure input port, and a medium pressure output port, wherein the primary high pressure input port is fluidly connected to the outlet side of the heat rejecting heat exchanger/gas cooler; a receiver, having a liquid outlet, a gas outlet and an inlet, which is fluidly connected to the output port of the at least one ejector; at least one compressor having an inlet side and an outlet side, the inlet side of the at least one compressor being fluidly connected to the gas outlet of the receiver and the outlet side of the at least one compressor being fluidly connected to the inlet side of the heat rejecting heat exchanger/gas cooler. The ejector refrigeration circuit further includes a refrigerating evaporator circuit comprising in the direction of flow of the circulating refrigerant a liquid pump having an inlet side, which is fluidly connected to the liquid outlet of the receiver, and an outlet side; at least one refrigeration expansion device having an inlet side, which is fluidly connected to the outlet side of the liquid pump, and an outlet side; and at least one refrigeration evaporator fluidly connected between the outlet side of the at least one refrigeration expansion device and the secondary low pressure input port of the at least one ejector. According to an exemplary embodiment of the invention the liquid pump is located outside the receiver and/or the liquid pump is provided with a bypass line including a switchable bypass valve for allowing refrigerant to selectively bypass the liquid pump by opening the switchable bypass valve.

As the efficiency of an ejector is a function of the high pressure drop, the efficiency decreases when the pressure difference between high and low pressure in the high pressure ejector circuit is low. In this case, the efficiency of an ejector refrigeration circuit can be enhanced by increasing the pressure within the refrigerating evaporator circuit by means of an additional liquid pump. Arranging said the liquid pump outside the receiver provides easy access for replacement and/or maintenance, if necessary.

Exemplary embodiments of the invention also include a method of operating an ejector refrigeration circuit comprising: a high pressure ejector circuit comprising in the direction of flow of a circulating refrigerant: a heat rejecting heat exchanger/gas cooler having an inlet side and an outlet side; at least one ejector comprising a primary high pressure input port, a secondary low pressure input port, and a medium pressure output port, with the primary high pressure input port being fluidly connected to the outlet side of the heat rejecting heat exchanger/gas cooler; a receiver, having a liquid outlet, a gas outlet and an inlet, which is fluidly connected to the output port of the at least one ejector; at least one compressor having an inlet side and an outlet side, the inlet side of the at least one compressor being fluidly connected to the gas outlet of the receiver and the outlet side of the at least one compressor being fluidly connected to the inlet side of the heat rejecting heat exchanger/gas cooler; and a refrigerating evaporator circuit comprising in the direction of flow of the circulating refrigerant a liquid pump having an inlet side, which is fluidly connected to the liquid outlet of the receiver, and an outlet side; at least one refrigeration expansion device having an inlet side, which is fluidly connected to the outlet side of the liquid pump, and an outlet side; and at least one refrigeration evaporator fluidly connected between the outlet side of the at least one refrigeration expansion device and the secondary low pressure input port of the at least one ejector, wherein the method includes operating the liquid pump for pumping liquid refrigerant through the refrigerating evaporator circuit and/or opening a switchable bypass valve for bypassing the liquid pump by means of a bypass line including the switchable bypass valve.

Opening the bypass valve for allowing the liquid refrigerant to bypass the non-operating liquid pump reduces or even avoids a pressure drop caused by the non-operating liquid pump, which could deteriorate the efficiency of the ejector refrigeration circuit.

SHORT DESCRIPTION OF THE FIGURES

Exemplary embodiments of the invention will be described in the following with respect to the enclosed figures.

DETAILED DESCRIPTION OF THE FIGURES

Figure 1:
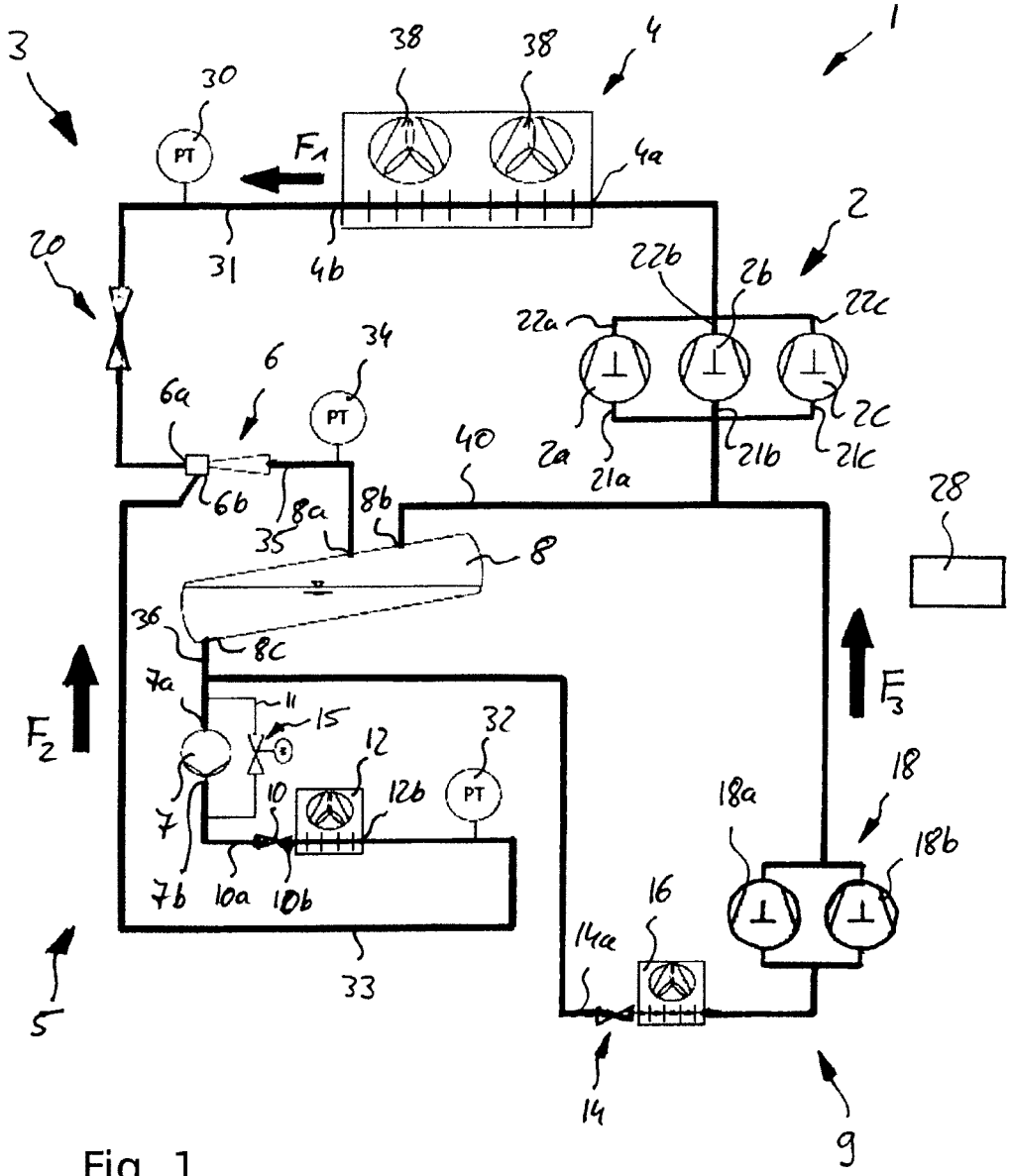
FIG. 1 illustrates a schematic view of an ejector refrigeration circuit according to an exemplary embodiment of the invention.

FIG. 1 illustrates a schematic view of an ejector refrigeration circuit 1 according to an exemplary embodiment of the invention comprising a high pressure ejector circuit 3, a refrigerating evaporator flowpath 5, and a low temperature flowpath 9 respectively circulating a refrigerant as indicated by the arrows $F_1$, $F_2$, and $F_3$.

The high pressure ejector circuit 3 comprises a compressor unit 2 including a plurality of compressors 2*a*, 2*b*, 2*c* connected in parallel.

The high pressure side outlets 22*a*, 22*b*, 22*c* of said compressors 2*a*, 2*b*, 2*c* are fluidly connected to an outlet manifold collecting the refrigerant from the compressors 2*a*, 2*b*, 2*c* and delivering the refrigerant via a heat rejection heat exchanger/gas cooler inlet line to the inlet side 4*a* of a heat rejecting heat exchanger/gas cooler 4. The heat rejecting heat exchanger/gas cooler 4 is configured for transferring heat from the refrigerant to the environment reducing the temperature of the refrigerant. In the exemplary embodiment shown in FIG. 1, the heat rejecting heat exchanger/gas cooler 4 comprises two fans 38 which are operable for blowing air through the heat rejecting heat exchanger/gas cooler 4 in order to enhance the transfer of heat from the refrigerant to the environment. Of course, the fans 38 are optional and their number may be adjusted to the actual needs.

The cooled refrigerant leaving the heat rejecting heat exchanger/gas cooler 4 at its outlet side 4*b* is delivered via a high pressure input line 31 and a an optional service valve 20 to a primary high pressure input port 6*a* of an ejector, which is configured for expanding the refrigerant to a reduced (medium) pressure level.

The expanded refrigerant leaves the ejector 6 through a respective ejector output port 6*c* and is delivered by means of an ejector output line 35 to an inlet 8*a* of a receiver 8. Within the receiver 8 the refrigerant is separated by means of gravity into a liquid portion collecting at the bottom of the receiver 8 and a gas phase portion collecting in an upper part of the receiver 8.

The gas phase portion of the refrigerant leaves the receiver 8 through a receiver gas outlet 8*b* provided at the top of the receiver 8. Said gas phase portion is delivered via a receiver gas outlet line 40 to the inlet sides 21*a*, 22*b*, 22*c* of the compressors 2*a*, 2*b*, 2*c* completing the refrigerant cycle of the high pressure ejector circuit 3.

Refrigerant from the liquid phase portion of the refrigerant collecting at the bottom of the receiver 8 exits from the receiver 8 via a liquid outlet 8*c* provided at the bottom of the receiver 8 and is delivered through a receiver liquid outlet line 36 to the inlet side 7*a* of a liquid pump 7 which is configured for increasing the pressure of the liquid refrigerant supplied from the receiver 8. The liquid pump 7 is located outside the receiver 8 allowing easy access for replacement and/or maintenance, if needed. The liquid pump 7 preferably is located below the receiver 8 allowing to use forces of gravity for supplying the liquid refrigerant from the receiver 8 to the inlet side 7*a* of the liquid pump 7.

A bypass-line 11 comprising a switchable bypass valve 15 connects the inlet side 7*a* of the liquid pump 7 with the outlet side 7*b* thereof, allowing the liquid refrigerant to bypass the liquid pump 7 by opening the bypass valve 15 when the liquid pump 7 is not operated.

The outlet side 7*b* of the liquid pump 7 is fluidly connected to the inlet side 10*a* of a refrigeration expansion device 10 ("medium temperature expansion device").

After having been expanded by the refrigeration expansion device 10 the refrigerant leaves the refrigeration expansion device 10 via the outlet side 10*b* thereof and enters into a refrigeration evaporator 12 ("medium temperature evaporator"), which is configured for operating at medium cooling temperatures, in particular in a temperature range of −10° C. to +5° C., for providing medium temperature refrigeration.

After having left the refrigeration evaporator 12 via its outlet 12*b*, the refrigerant flows via a low pressure inlet line 33 to a secondary low pressure input port 6*b* of the ejector 6. In operation, the refrigerant leaving the refrigeration evaporator 12 is sucked through the secondary low pressure input port 6*b* into the ejector 6 by means of the high pressure flow entering via the respective primary high pressure input port 6. The functionality of the ejector 6 will be described in more detail below with reference to FIG. 3.

Under operational conditions, in which the pressure drop between the primary high pressure input port 6*a* of the ejector 6 and its output port 6*c* is not large enough for causing a suction of refrigerant through the refrigeration expansion device 10 and the refrigeration evaporator 12, which is sufficient for an effective operation of the ejector refrigeration circuit 1, the liquid pump 7 may be operated with the bypass valve 15 being closed. By operating the liquid pump 7 the pressure of the liquid refrigerant, which is delivered to the refrigeration expansion device 10 and the refrigeration evaporator 12, is increased. Operating the liquid pump 7 also increases the mass flow of refrigerant flowing through the refrigeration expansion device 10 and the refrigeration evaporator 12. As a result, the refrigeration capacity of the ejector refrigeration circuit 1 is increased.

On the other hand, under different operational conditions, in which the pressure drop between the primary high pressure input port 6*a* of the ejector 6 and its output port 6*c* is large enough for causing a sufficient suction of refrigerant through the refrigeration expansion device 10 and the refrigeration evaporator 12, as it is needed for an effective operation of the ejector refrigeration circuit 1, the operation of the liquid pump 7, which is not needed anymore, is stopped. In case a bypass-line 11 including a bypass valve 15 is present, the bypass valve 15 may be opened for allowing the liquid refrigerant to bypass the non-operating liquid pump 7 in order to avoid or at least reduce any pressure drop that may be caused by the non-operating liquid pump 7.

Optionally, the inlet side 14*a* of a low temperature expansion device 14 is fluidly connected to the receiver liquid outlet line 36 upstream of the liquid pump 7 allowing a portion of the liquid refrigerant leaving the receiver 8 to be expanded by a low temperature expansion device 14. The expanded refrigerant then enters into an optional low temperature evaporator 16, which in particular is configured for operating at low temperatures, in particular at temperatures in the range of −40° C. to −25° C., for providing low temperature refrigeration. The refrigerant that has left the low temperature evaporator 16 is delivered to the inlet side of a low temperature compressor unit 18 comprising one or more, in the embodiment shown in FIG. 1 two, low temperature compressors 18*a*, 18*b*.

In operation, the low temperature compressor unit 18 compresses the refrigerant supplied by the low temperature evaporator 16 to medium pressure, i.e. basically the same pressure as the pressure of the refrigerant which is delivered from the gas outlet 8*b* of the receiver 8. The compressed refrigerant is supplied together with the refrigerant provided from the gas outlet 8*b* of the receiver 8 to the inlet sides 21*a*, 21*b*, 21*c* of the compressors 2*a*, 2*b*, 2*c*.

The ejector 6 may be a controllable ejector 6 allowing to control the flow of refrigerant through the primary high pressure input port 6*a*, as will be described in more detail further below with reference to FIG. 3.

Alternatively or additionally, a plurality of controllable or non-controllable ejectors 6 connected in parallel may be provided for allowing to adjust the ejector capacity to the actual needs by selectively activating a suitable selection of ejectors 6.

Sensors 30, 32, 34, which are configured for measuring the pressure and/or the temperature of the refrigerant, are respectively provided at the high pressure input line 31 fluidly connected to the primary high pressure input port 6*a* of the ejector 6, the low pressure input line 33 fluidly connected to the secondary low pressure input port 6*b* and the output line 35 fluidly connected to the output port 6*c* of the ejector 6. A control unit 28 is configured for controlling the operation of the ejector refrigeration circuit 1, in particular the operation of the compressors 2*a*, 2*b*, 2*b*, 18*a*, 18*b*, the ejector 6, if it is controllable, the liquid pump 7 and/or the bypass valve 15 based on the pressure value(s) and/or the temperature value(s) measured by the sensors 30, 32, 34 and the actual refrigeration demands.

Figure 2:
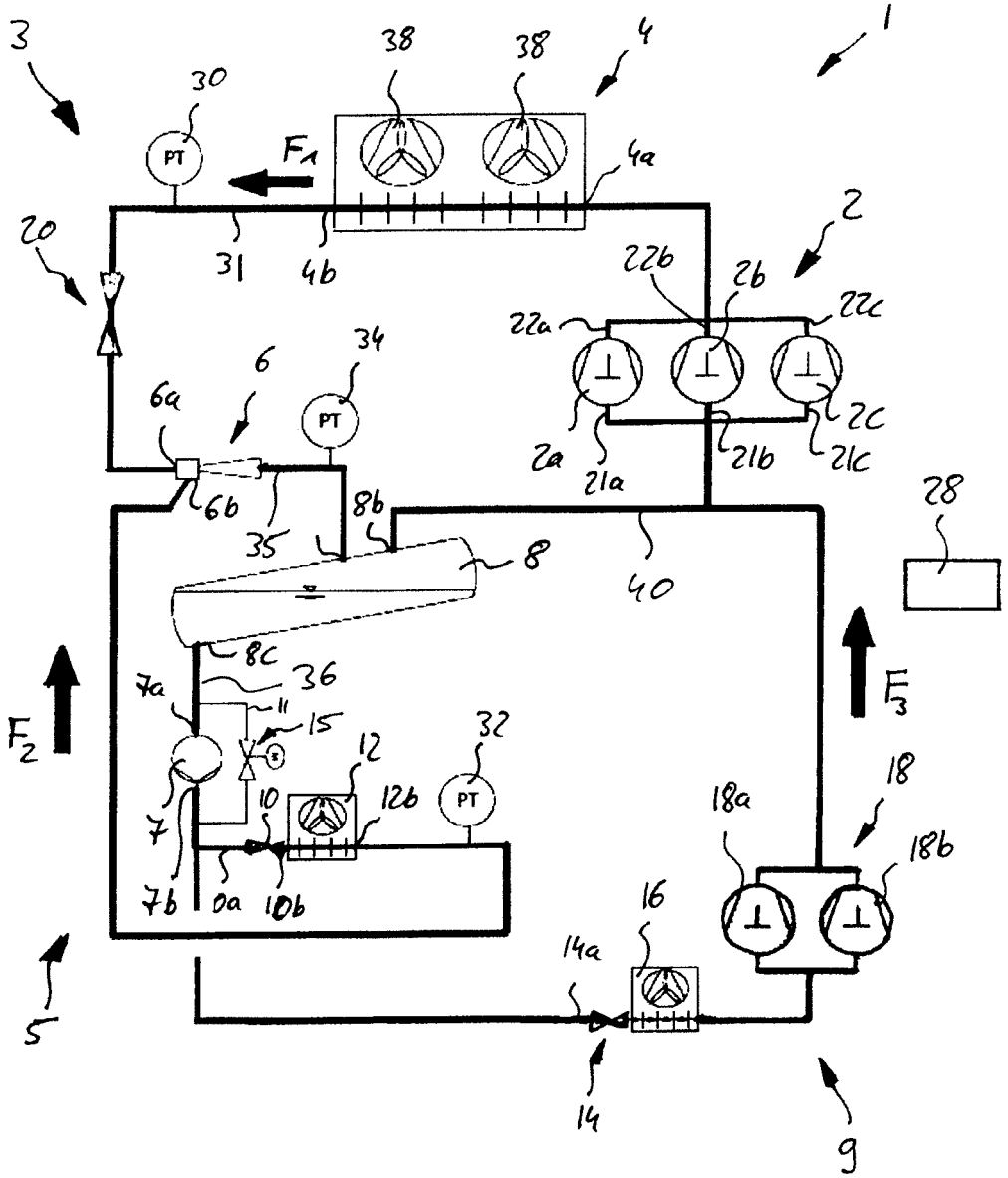
FIG. 2 illustrates a schematic view of an ejector refrigeration circuit according to another exemplary embodiment of the invention.

FIG. 2 illustrates a schematic view of an ejector refrigeration circuit 1 according to an alternative exemplary embodiment of the invention. The configuration of the ejector refrigeration circuit 1 is basically similar to the configuration of the first embodiment shown in FIG. 1; in consequence identical elements are designated with the same reference signs and will not be discussed in detail again.

Deviating from the first embodiment, the input side 14*a* of the low temperature expansion device 14 is fluidly connected not to the inlet side 7*a* but to the outlet side 7*b* of the liquid pump 7. This configuration allows to increase the pressure of the liquid refrigerant flowing through the low temperature expansion device 14 and through the low temperature evaporator 14, as well.

In a further embodiment, which is not shown in the figures, separate liquid pumps 7 and bypass-lines 11 may be provided for the refrigerating evaporator flowpath 5 and the low temperature flowpath 9, respectively. Such a configuration allows to adjust the pressure of the liquid refrigerant flowing through the refrigerating evaporator flowpath 5 independently from the pressure of the refrigerant flowing through the low temperature flowpath 9.

Figure 3:
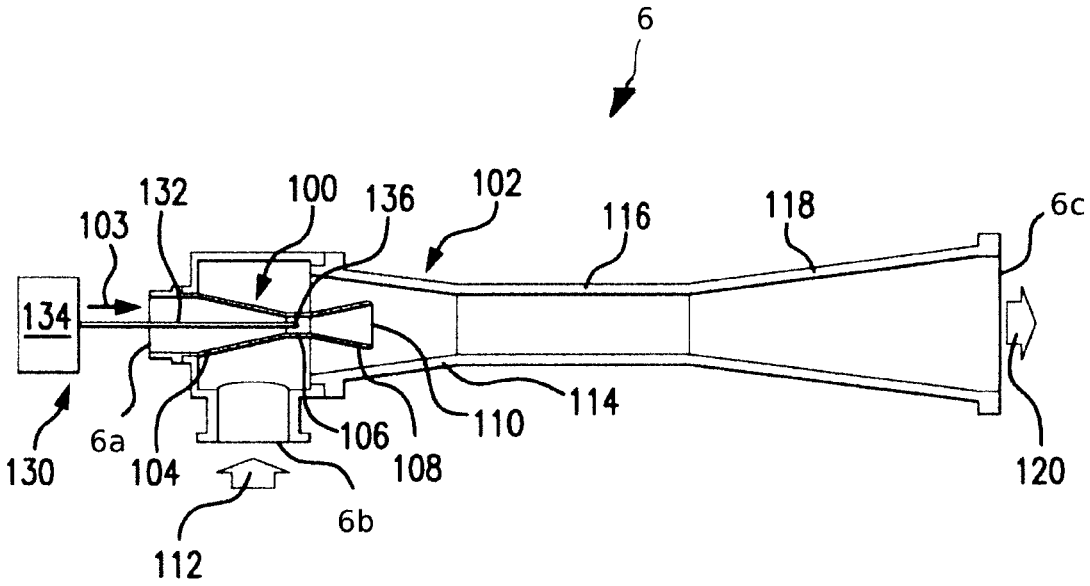
FIG. 3 illustrates a schematic sectional view of a controllable ejector as it may be employed in the exemplary embodiments shown in FIGS. 1 and 2.

FIG. 3 illustrates a schematic sectional view of an exemplary embodiment of a controllable ejector 6 as it may be employed as the ejector 6 in the ejector refrigeration circuit 1 shown in FIG. 1.

The ejector 6 is formed by a motive nozzle 100 nested within an outer member 102. The primary high pressure input port 6*a* forms the inlet to the motive nozzle 100. The outlet of the outer member 102 provides the output port 6*c* of the ejector 6. A primary refrigerant flow 103 enters the primary high pressure input port 6*a* and then passes into a convergent section 104 of the motive nozzle 100. It then passes through a throat section 106 and a divergent expansion section 108 to an outlet 110 of the motive nozzle 100. The motive nozzle 100 accelerates the flow 103 and decreases the pressure of the flow. The secondary low pressure input port 6*b* forms an inlet of the outer member 102. The pressure reduction caused to the primary flow by the motive nozzle draws a secondary flow 112 into the outer member 102. The outer member 102 includes a mixer having a convergent section 114 and an elongate throat or mixing section 116. The outer member 102 also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. Thus, respective primary and secondary flowpaths respectively extend from the primary high pressure input port 6*a* and secondary low pressure input port 6*b* to the output port 6*c*, merging at the exit.

In operation, the primary flow 103 may be supercritical upon entering the ejector 6 and subcritical upon exiting the motive nozzle 100. The secondary flow 112 may be gaseous or a mixture of gas with a smaller amount of liquid upon entering the secondary low pressure input port 6*b*. The resulting combined flow 120 is a liquid/vapor mixture and decelerates and recovers pressure in the diffuser 118 while remaining a mixture.

The ejector 6 employed in exemplary embodiments of the invention may be a controllable ejector 6. In this case, controllability is provided by a needle valve 130 having a needle 132 and an actuator 134. The actuator 134 is configured for shifting a tip portion 136 of the needle 132 into and out of the throat section 106 of the motive nozzle 100 to modulate flow through the motive nozzle 100 and, in turn, the ejector 6 overall. Exemplary actuators 134 are electric, e.g. solenoid or the like. The actuator 134 may be coupled to and controlled by the control unit 28. The control unit 28 may be coupled to the actuator 134 and other controllable system components via hardwired or wireless communication paths. The control unit 28 may include one or more of: processors; memory (e.g., for storing program information for execution by the processor to perform the operational methods and for storing data used or generated by the program(s)); and hardware interface devices (e.g., ports) for interfacing with input/output devices and controllable system components.

Further Embodiments

A number of optional features are set out in the following. These features may be realized in particular embodiments, alone or in combination with any of the other features.

In an embodiment the liquid pump is located below the receiver. Arranging the liquid pump below the receiver allows to use the forces of gravity for supplying the liquid refrigerant from the receiver to the inlet side of the liquid pump.

In an embodiment the ejector refrigeration circuit comprises a plurality of ejectors connected in parallel. The ejectors may have different or identical capacities. Providing a plurality of ejectors connected in parallel allows to adjust the capacity of the ejector refrigeration circuit by operating an appropriate selection of the plurality of ejectors. Said selection may comprise a single ejector or a plurality of the ejectors.

At least one of the ejectors may be a controllable variable ejector allowing to adjust the capacity of the ejector refrigeration circuit even better.

In an embodiment at least one sensor, which is configured for measuring the pressure and/or the temperature of the refrigerant, is provided in at least one of a high pressure input line fluidly connected to the primary high pressure input port, a low pressure input line fluidly connected to the secondary low pressure input port and an output line fluidly connected to the output port of the ejector, respectively. Such a sensor allows for optimizing the operation of the ejector refrigeration circuit based on the measured pressures and/or temperatures.

In an embodiment the ejector refrigeration circuit further comprises a control unit which is configured for controlling the at least one compressor, the liquid pump, and/or at least one ejector, if it is variable, based on the pressure values and/or temperature values measured by the at least one pressure and/or temperature sensor for operating the ejector refrigeration circuit as efficiently as possible.

In an embodiment at least one service valve is provided upstream of the ejector's primary high pressure input port allowing to shut down the flow of refrigerant to the primary high pressure input port in case the ejector needs to be maintained or replaced.

In an embodiment the ejector refrigeration circuit further comprises at least one low temperature flowpath, which is connected between the liquid outlet of the receiver and the inlet side of the at least one compressor and comprises in the direction of flow of the refrigerant: at least one low temperature expansion device; at least one low temperature evaporator; and at least one low temperature compressor for providing lower temperatures, in particular low temperatures in addition to medium temperatures.

In an alternative embodiment the at least one low temperature flowpath, which comprises in the direction of flow of the refrigerant at least one low temperature expansion device, at least one low temperature evaporator, and at least one low temperature compressor is connected between the outlet side of the liquid pump/bypass valve and the inlet side of the at least one compressor. Such a configuration allows the liquid pump to increase the pressure of the refrigerant flowing through the low temperature flowpath, as well.

In a further embodiment separate liquid pumps and (optional) bypass-lines are provided for the refrigerating evaporator flowpath and the low temperature flowpath, respectively, allowing to adjust the pressure of the liquid refrigerant flowing through the refrigerating evaporator flowpath and the pressure of the refrigerant flowing through the low temperature flowpath independently of each other.

In an embodiment the method of operating the ejector refrigeration circuit includes operating the at least one low temperature flowpath for providing low temperatures, in particular low, temperatures, at the low temperature evaporator.

In an embodiment the method of operating the ejector refrigeration circuit includes controlling the at least one compressor, the liquid pump and/or the switchable bypass valve based on the output value(s) of at least one of the pressure and/or the temperature sensors for operating the ejector refrigeration circuit as efficiently as possible.

In an embodiment the method of operating the ejector refrigeration circuit includes controlling a controllable ejector, in particular based on the output value(s) of at least one of the pressure and/or the temperature sensors for operating the ejector refrigeration circuit as efficiently as possible.

In an embodiment the method of operating the ejector refrigeration circuit includes selectively operating one or more of at least two ejectors connected in parallel, in particular based on the output value(s) of at least one of the pressure and/or the temperature sensors, for operating the ejector refrigeration circuit as efficiently as possible.

In an embodiment the method of operating the ejector refrigeration circuit includes using carbon dioxide as refrigerant circulating within the ejector refrigeration circuit.

While the invention has been described with reference to exemplary embodiments, it will be understood by those skilled in the art that various changes may be made and equivalence may be substitute for elements thereof without departing from the scope of the invention. In particular, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pending claims.

Reference Numerals

1 ejector refrigeration circuit
2 compressor unit
2*a*, 2*b*, 2*c* compressors
3 high pressure ejector circuit
4 heat rejecting heat exchanger/gas cooler
4*a* inlet side of the heat rejecting heat exchanger/gas cooler
4*b* outlet side of the heat rejecting heat exchanger/gas cooler
5 refrigerating evaporator flowpath
6 first controllable ejector
6*a* primary high pressure input port of the first controllable ejector
6*b* secondary low pressure input port of the first controllable ejector
6*c* output port of the first controllable ejector
7 liquid pump
7*a* inlet side of the liquid pump
7*b* outlet side of the liquid pump
8 receiver
8*a* inlet of the receiver
8*b* gas outlet of the receiver
8*c* liquid outlet of the receiver
9 low temperature flowpath
10 refrigeration expansion device
10*a* inlet side of the refrigeration expansion device
10*b* outlet side of the refrigeration expansion device
11 bypass-line
12 refrigeration evaporator
12*b* outlet of the refrigeration evaporator
14 low temperature expansion device
14*a* inlet side of the low temperature expansion device
15 bypass valve
16 low temperature evaporator
18 low temperature compressor unit
18*a*, 18*b* low temperature compressors
20 service valve
21*a*, 21*b*, 21*c* inlet side of the compressors
22*a*, 22*b*, 22*c* outlet side of the compressors
28 control unit
30 pressure and/or temperature sensor
31 high pressure input line
32 pressure and/or temperature sensor
33 low pressure input line
34 pressure and/or temperature sensor
35 ejector output line
36 receiver liquid outlet line
38 fan of the heat rejecting heat exchanger/gas cooler
40 receiver gas outlet line
100 motive nozzle
102 outer member
103 primary refrigerant flow
104 convergent section of the motive nozzle
106 throat section
108 divergent expansion section
110 outlet of the motive nozzle
112 secondary flow
114 convergent section of the mixer
116 throat or mixing section
118 diffuser
120 combined flow
130 needle valve
132 needle
134 actuator

The invention claimed is:

1. Ejector refrigeration circuit with:

a high pressure ejector circuit comprising in the direction of flow of a circulating refrigerant:

a heat rejecting heat exchanger/gas cooler having an inlet side and an outlet side;

at least one ejector comprising a primary high pressure input port, a secondary low pressure input port, and an output port, the primary high pressure input port being fluidly connected to the outlet side of the heat rejecting heat exchanger/gas cooler;

a receiver, having a liquid outlet, a gas outlet and an inlet, which is fluidly connected to the output port of the at least one ejector;

at least one compressor having an inlet side and an outlet side, the inlet side of the at least one compressor being fluidly connected to gas outlet of the receiver and the outlet side of the at least one compressor being fluidly connected to the inlet side of the heat rejecting heat exchanger/gas cooler; and a refrigerating evaporator flowpath comprising in the direction of flow of the circulating refrigerant:

a liquid pump having an inlet side, which is fluidly connected to the liquid outlet of the receiver, and an outlet side;

at least one refrigeration expansion device having an inlet side, which is fluidly connected to the outlet side of the liquid pump, and an outlet side; and at least one refrigeration evaporator fluidly connected between the outlet side of the at least one refrigeration expansion device and the secondary low pressure input port of the at least one ejector;

wherein the liquid pump comprises a bypass-line including a switchable bypass valve allowing refrigerant to selectively bypass the liquid pump by opening the switchable bypass valve.

2. Ejector refrigeration circuit of claim 1, comprising a plurality of ejectors connected in parallel.

3. Ejector refrigeration circuit of claim 2, wherein the ejector refrigeration circuit comprises at least two ejectors with different capacities.

4. Ejector refrigeration circuit of claim 1, comprising at least one controllable variable ejector.

5. Ejector refrigeration circuit of claim 1, wherein at least one of a pressure and a temperature sensor is provided in at least one of a high pressure inlet line fluidly connected to the primary high pressure input port, a low pressure inlet line fluidly connected to the secondary low pressure input port and an ejector outlet line fluidly connected to the output port of the at least one ejector, respectively.

6. Ejector refrigeration circuit of claim 5, further comprising a control unit, which is configured for controlling at least one of the at least one compressor, the liquid pump and a variable ejector, if present, based on the pressure values and measured by the at least one pressure sensor.

7. Ejector refrigeration circuit of claim 1, further comprising at least one low temperature flowpath, which includes in the direction of flow of the refrigerant:

at least one low temperature expansion device;

at least one low temperature evaporator; and at least one low temperature compressor, with the low temperature flowpath being connected between the liquid outlet of the receiver and the inlet side of the at least one compressor.

8. Ejector refrigeration circuit of claim 1 being configured for using carbon dioxide as refrigerant.

9. Ejector refrigeration circuit of claim 1, wherein the liquid pump is located outside the receiver.

10. Ejector refrigeration circuit of claim 5, further comprising a control unit, which is configured for controlling at least one of the at least one compressor, the liquid pump and variable ejector, if present, based on the pressure values measured by the at least one temperature sensor.

11. Ejector refrigeration circuit of claim 1, further comprising at least one low temperature flowpath, which includes in the direction of flow of the refrigerant:

at least one low temperature expansion device;

at least one low temperature evaporator; and at least one low temperature compressor, with the low temperature flowpath being connected between the outlet side of the fluid pump and the inlet side of the at least one compressor.

12. Method of operating an ejector refrigeration circuit with:

a high pressure ejector circuit comprising in the direction of flow of a circulating refrigerant:

a heat rejecting heat exchanger/gas cooler having an inlet side and an outlet side;

at least one ejector comprising a primary high pressure input port, a secondary low pressure input port, and an output port, the primary high pressure input port being fluidly connected to the outlet side of the heat rejecting heat exchanger/gas cooler;

a receiver, having a liquid outlet, a gas outlet and an inlet, which is fluidly connected to the output port of the at least one ejector;

at least one compressor having an inlet side and an outlet side, the inlet side of the at least one compressor being fluidly connected to gas outlet of the receiver, and the outlet side of the at least one compressor being fluidly connected to the inlet side of the heat rejecting heat exchanger/gas cooler; and a refrigerating evaporator flowpath comprising in the direction of flow of the circulating refrigerant:

a liquid pump, which has an inlet side fluidly connected to the liquid outlet of the receiver, an outlet side, and a bypass-line including a switchable bypass valve allowing refrigerant to selectively bypass the liquid pump by opening the switchable bypass valve;

at least one refrigeration expansion device having an inlet side, which is fluidly connected to the outlet side of the liquid pump, and an outlet side; and at least one refrigeration evaporator fluidly connected between the outlet side of the at least one refrigeration expansion device and the secondary low pressure input port of the at least one ejector;

wherein the method comprises opening the switchable bypass valve for bypassing the liquid pump by means of the bypass-line.

13. Method of claim 12, wherein at least one pressure sensor is provided in at least one of a high pressure inlet line fluidly connected to the primary high pressure input port, a low pressure inlet line fluidly connected to the secondary low pressure input port and an ejector outlet line fluidly connected to the output port of the at least one ejector, respectively, and the method includes controlling at least one of the at least one compressor, the liquid pump and the switchable bypass valve based on the output of the at least one pressure sensor.

14. Method of claim 13, wherein the ejector is a controllable variable ejector and the method includes controlling the ejector in particular based on the output of the at least one pressure sensor.

15. Method of claim 12, wherein the ejector refrigeration circuit comprises at least two ejectors connected in parallel and the method comprises selectively operating one or more of the these ejectors.

16. Method of claim 12, wherein the ejector refrigeration circuit further comprises at least one low temperature flowpath which is connected between the liquid outlet of the receiver and the inlet side of the at least one compressor and comprises in the direction of flow of the refrigerant:

at least one low temperature expansion device;

at least one low temperature evaporator; and at least one low temperature compressor;

and the method comprises operating the at least one low temperature flowpath for providing low temperatures, at the low temperature evaporator.

17. Method of claim 12, wherein the ejector refrigeration circuit further comprises at least one low temperature flowpath which is connected between the outlet side of the fluid pump and the inlet side of the at least one compressor and comprises in the direction of flow of the refrigerant:

at least one low temperature expansion device;

at least one low temperature evaporator; and at least one low temperature compressor;

and the method comprises operating the at least one low temperature flowpath for providing low temperatures, at the low temperature evaporator.

18. Method of claim 12 including using carbon dioxide as refrigerant.

19. Method of claim 12, wherein at least one temperature sensor is provided in at least one of a high pressure inlet line fluidly connected to the primary high pressure input port, a low pressure inlet line fluidly connected to the secondary low pressure input port and an ejector outlet line fluidly connected to the output port of the at least one ejector, respectively, and the method includes controlling at least one of the at least one compressor, the liquid pump and the switchable bypass valve based on the output of the at least one temperature sensor.

20. Method of claim 19, wherein the ejector is a controllable variable ejector and the method includes controlling the ejector based on the output of the at least one temperature sensor.

* * * * *